US005871636A

United States Patent [19]

Trachte et al.

[11] Patent Number: 5,871,636

[45] Date of Patent: Feb. 16, 1999

[54] CATALYTIC REDUCTION OF ACIDITY OF CRUDE OILS IN THE ABSENCE OF HYDROGEN

[75] Inventors: Kenneth L. Trachte, Baton Rouge, La.; Jacob B. Angelo, Spring; Keith K. Aldous, League City, both of Tex.

[73] Assignee: Exxon Research and Engineering Company, Florham Park, N.J.

[21] Appl. No.: 920,421

[22] Filed: Aug. 29, 1997

[51] Int. Cl.[6] ..... C10G 29/04; C10G 17/00

[52] U.S. Cl. ..... 208/263; 208/208 R

[58] Field of Search ..... 208/263, 208 R

[56] References Cited

U.S. PATENT DOCUMENTS

| | | | |
|---|---|---|---|
| 2,724,019 | 2/1955 | Miller et al. | 196/24 |
| 2,921,023 | 1/1960 | Holm | 208/263 |
| 3,488,716 | 1/1970 | Eng | 208/263 |
| 3,876,532 | 4/1975 | Plundo | 208/216 |
| 3,925,220 | 12/1975 | Mills | 208/14 |
| 4,801,373 | 1/1989 | Corman et al. | 208/210 |

FOREIGN PATENT DOCUMENTS

| | | | |
|---|---|---|---|
| 1236230 | 9/1968 | United Kingdom | C10G 29/10 |
| 1236230 | 6/1971 | United Kingdom | 208/216 |
| WO 96/06899 | 3/1996 | WIPO | C10G 45/50 |

*Primary Examiner*—Helane Myers
*Attorney, Agent, or Firm*—James H. Takemoto

[57] ABSTRACT

A process for reducing the acidity of acidic crude oils by contacting the crude oil with a hydrotreating catalyst in the absence of hydrogen.

4 Claims, 2 Drawing Sheets

CATALYTIC REDUCTION OF ACIDITY OF CRUDE OILS IN THE ABSENCE OF HYDROGEN

FIELD OF THE INVENTION

This invention relates to a process for improving the processibility of high acid crude oils by catalytically reducing the acidity of the oils.

BACKGROUND OF THE INVENTION

Because of market constraints, it is becoming more necessary to process highly acidic crudes such as acidic naphthenic crudes. It is well known that processing such acidic crudes can lead to various problems associated with naphthenic and other acid corrosion. A number of methods to reduce the Total Acid Number (TAN), which is the number of milligrams of potassium hydroxide required to neutralize the acid content of one gram of crude oil, have been proposed.

One approach is to chemically neutralize acidic components with various bases. This method suffers from processing problems such as emulsion formation, increase in sodium concentration in the crude and additional processing steps. Another approach is to use corrosion-resistant metals in processing units. This, however, involves significant expense and may not be economically feasible for existing units. A further approach is to add corrosion inhibitors to the crudes. This suffers from the effects of the corrosion inhibitors on downstream units, for example, insufficient coverage of the entire metal surface, lowering of catalyst life/efficiency and potential produce quality impact. Another option is to lower crude acid content by blending the acidic crude with crudes having a low acid content. The limited supplies of such low acid crudes makes this approach increasingly difficult.

British patent 1,236,230 discloses a process for removing naphthenic acids from petroleum distillate fractions without the addition of gaseous hydrogen by contacting the distillate fraction with a catalyst containing nickel, tungsten molybdenum, cobalt, iron or combinations thereof at mild processing conditions. U.S. Pat. No. 2,921,023 describes a process for maintaining the activity of certain molybdenum catalysts during the hydrogenation of organic materials. The catalysts may be used to hydrogenate heavy petroleum fractions in which the amounts of oxy-compounds such as naphthenic acids is reduced.

It would be desirable to reduce the acidity of crude oils without the addition of neutralization/corrosion protection agents and without converting the crude into product streams.

SUMMARY OF THE INVENTION

This invention relates to a process for reducing the acidity of an acidic crude oil which comprises contacting the crude oil with a hydrotreating catalyst in the absence of hydrogen at a temperature from about 285° to 345° C.

DETAILED DESCRIPTION OF THE INVENTION

Figure 1:
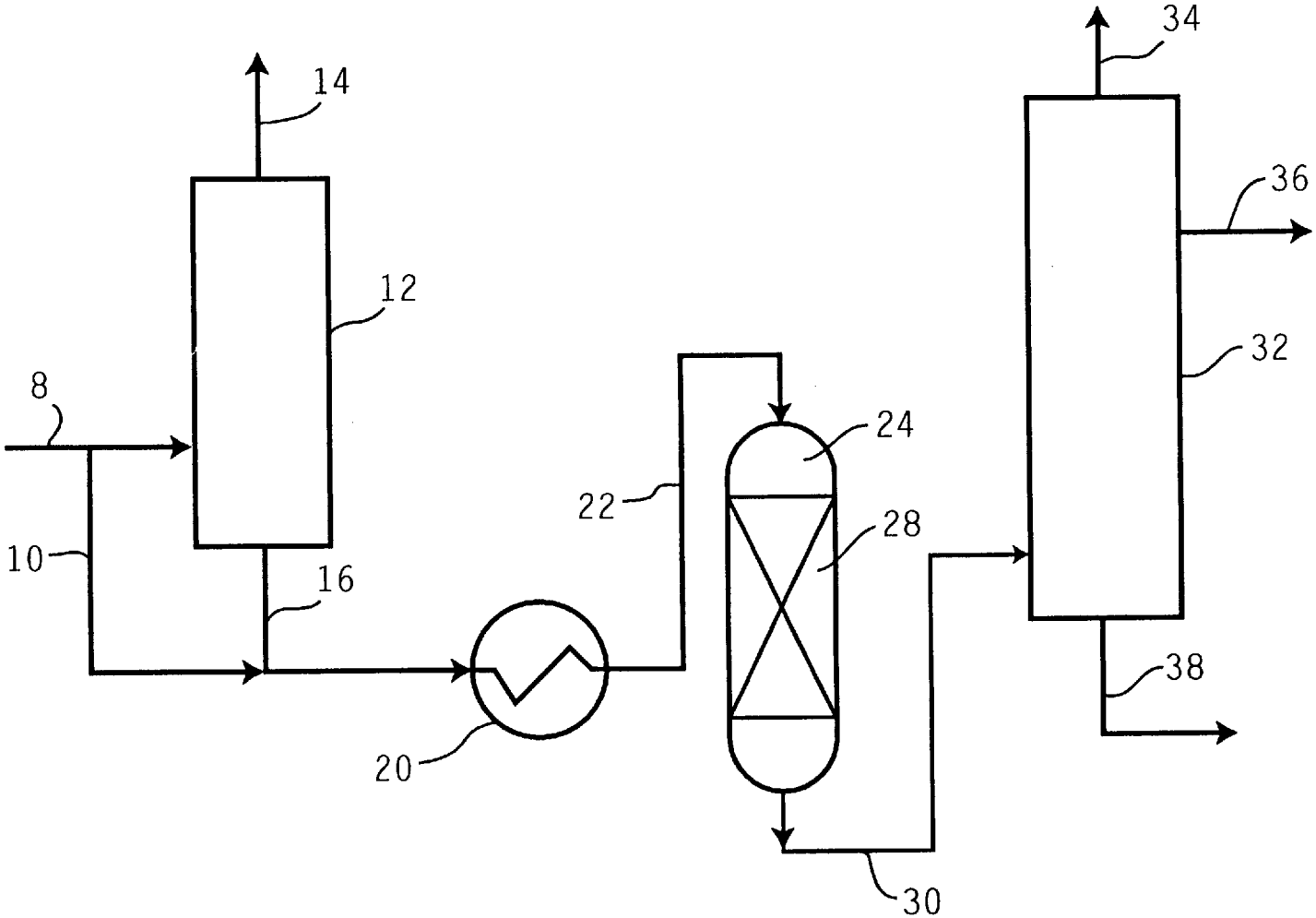
FIG. 1 is a simplified schematic flow diagram of the process for reducing the acidity of acidic crude oils.

Acidic crudes typically contain naphthenic and other acids and have TAN numbers of 1 up to 8. It has been discovered that the TAN value of an acidic whole crude or a topped crude, which whole or topped crude has not been subjected to fractionation into product streams, can be reduced by treating the crude under relatively mild conditions with a hydrotreating catalyst in the absence of added hydrogen. Hydrotreating catalysts are normally used to saturate olefins and aromatics, and reduce nitrogen and/or sulfur contents of refinery feedstreams. It has been found that such catalysts can also reduce the acidity of crudes by reducing the concentration of acidic components in crude oils, notably naphthenic acids even in the absence of added hydrogen. Thus the present process does not require the addition of hydrogen or a hydrogen-containing gas such as a recycle gas in order to accomplish TAN reduction.

Hydrotreating catalysts are those containing Group VIB metals (based on the Periodic Table published by Fisher Scientific) and non-noble Group VIII metal. These metals or mixtures of metals are typically present as oxides or sulfides on refractory metal supports. Examples of such catalysts are cobalt and molybdenum oxides on a support such as alumina. Other examples include cobalt/nickel/molybdenum or nickel/molybdenum on a support such as alumina. Such catalysts are typically activated by sulfiding prior to use. Preferred catalysts include cobalt/molybdenum (1–5% Co as oxide, 10–25% Mo as oxide), nickel/molybdenum (1–5% Ni as oxide, 10–25% Co as oxide) and nickel/tungsten (1–5% Ni as oxide, 10–30% W as oxide) on alumina. Especially preferred are nickel/molybdenum and cobalt/molybdenum catalysts.

Suitable refractory metal supports are naturally occurring or synthetic materials as well as inorganic materials such as clays, silica and/or metal oxides which are resistant to temperature and reaction conditions of the subject process. Examples of metal oxides include silica, alumina, titania and mixtures thereof. Low acidity metal oxide supports are preferred. Particularly preferred supports are porous aluminas such as gamma or beta aluminas having average pore sizes from 50 to 200 Å, a surface area from 100 to 300 $m^2/g$ and a pore volume from 0.25 to 1.0 $cm^3/g$. It is also preferred that the supports not be promoted with a halogen or other acidic species as these species may enhance cracking/isomerization reactions.

Reaction conditions for contacting acidic crude with hydrotreating catalysts include temperatures from about 285° to 345° C., preferably 285° to 316° C. and a LHSV from 1 to 8, preferably 2 to 4. While the process according to the invention uses a hydrotreating catalyst, it is not necessary that hydrogen be present.

In a typical refining process, heated crude oils are conducted to a pre-flash tower to remove most of the products having boiling points of less than about 100° C. prior to distillation in an atmospheric tower. This reduces the load on the atmospheric tower. The present process for reducing the acidity of highly acidic crudes utilizes a heat exchanger and/or furnace, and a catalytic treatment zone prior to the atmospheric tower. The heat exchanger preheats the crude oil to temperatures of about 285° to 345° C. The heated crude is then conducted to a catalytic treatment zone which includes a reactor and catalyst. The reactor is preferably a conventional trickle bed reactor wherein crude oil is conducted downwardly through a fixed bed of catalyst.

The process of the invention is further illustrated by FIG. 1. Crude oil which may be desalted and/or preheated is conducted through line 8 to pre-flash tower 12. Overheads containing gases and liquids such as light naphthas are removed from the pre-flash tower through line 14. The remaining crude oil is conducted through line 16 to heater 20. Alternatively, crude oil may be conducted directly to heater 20 via lines 10 and 16. The heated crude oil from heater 20 is then conducted to reactor 24 via line 22. The order of heater 20 and reactor 24 may be reversed provided that the crude oil entering reactor 24 is of sufficient temperature to meet the temperature requirements of reactor 24. In reactor 24, crude oil is contacted with a bed of hot catalyst 28. Crude oil flows downwardly through the catalyst bed 28 and is conducted through line 30 to atmospheric tower 32. Atmospheric tower 30 operates in a conventional manner to produce overheads which are removed through line 34, various distillation fractions such as heavy virgin naphtha, middle distillates, heavy gas oil and process gas oil which are shown as collectively removed through line 36. Reduced crude is removed through line 38 for further processing in a vacuum distillation tower (not shown).

In reactor 24, the TAN of the crude oil is catalytically reduced by converting acidic components in the crude oil to CO, $CO_2$ and $H_2O$. Catalytic conversion may be accomplished by decarboxylation and/or hydrogenolysis of the acid function.

The invention is further illustrated by the following non-limiting examples.

EXAMPLE 1

This example is directed to the TAN reduction of a high acid crude having an initial total number (TAN) of 4.0. A pilot unit was loaded with KF-756 which is a commercially available cobalt/molybdenum catalyst from Akzo Nobel. The unit was run at a liquid hourly space velocity (LHSV) of 2 and temperatures of 288° C. (550° F.), 316° C. (600° F.), and 343° C. (650° F.). Inert gas (nitrogen) at 100 psig was used to aid in pressure control of the pilot unit. The results are shown in Table 1 and FIG. 2.

TABLE 1

| Temperature (°C.) | $H_2$ Pressure | LHSV | TAN | % TAN Reduction |
|---|---|---|---|---|
| 288 | 0 | 2 | 2.9 | 20 |
| 316 | 0 | 2 | 1.8 | 53 |
| 343 | 0 | 2 | >2 | <50 |

Figure 2:
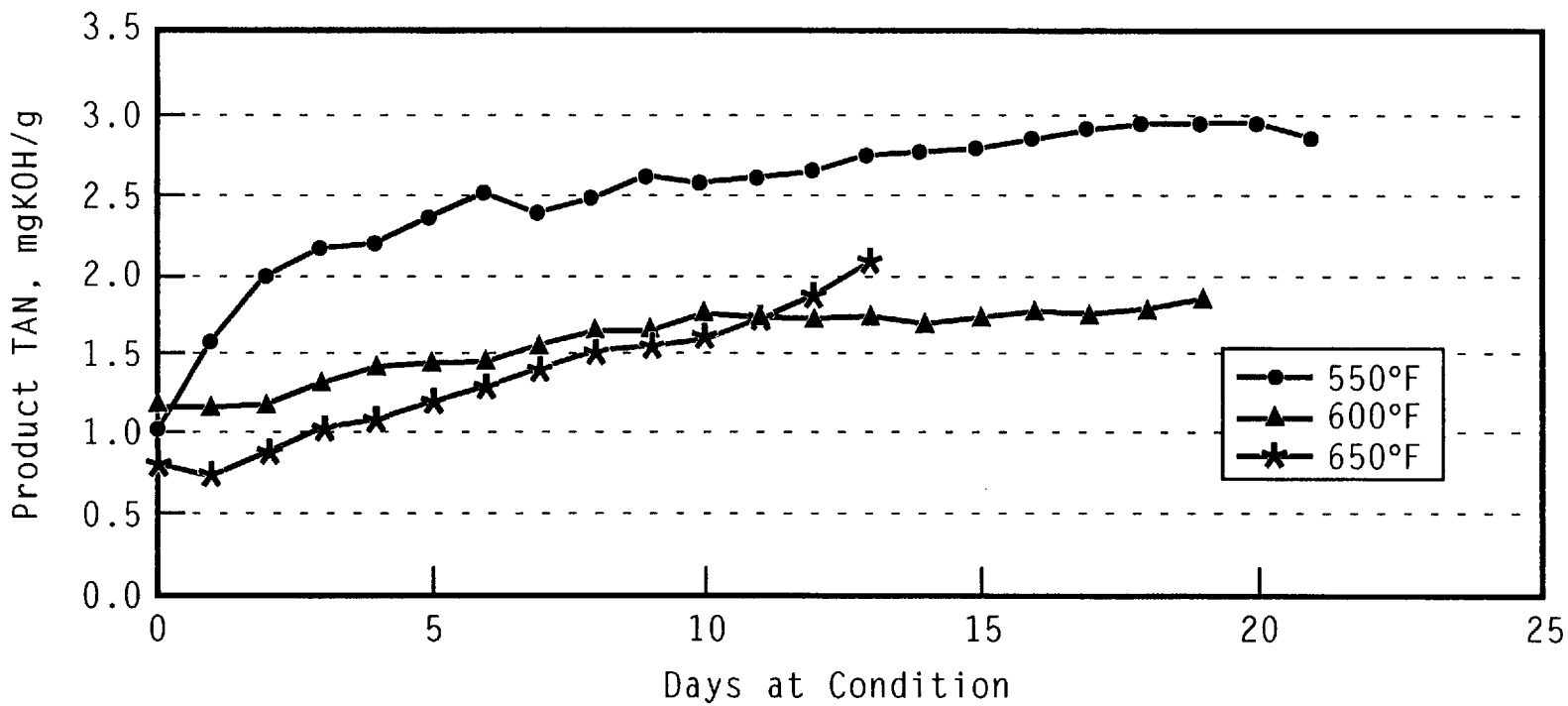
FIG. 2 is a graph showing reduction of TAN of crude oil as a function of temperature.

FIG. 2 is a graph showing TAN reduction as a function of time. As can be seen from FIG. 2, crude oil which is catalytically treated has a lower TAN over the feed and the TAN reduction can be maintained after a period of days, except at 343° C. where TAN lineout was not demonstrated in the experimental timeframe. Processing of crude oil in the absence of hydrogen offers the opportunity for substantial savings in both capital investment (no high pressure reaction vessel required and no need added gas lines) and operating costs. The reduced TAN crude can be further processed or can be blended with low acidity crudes.

What is claimed is:

1. A process for reducing the acidity of an acidic crude oil which comprises contacting the crude oil which has not been fractionated into product streams with a hydrotreating catalyst in the absence of hydrogen at a temperature from about 285° to 345° C.

2. The process of claim 1 wherein the crude oil is contacted with catalyst at a LHSV of from 1 to 8.

3. The process of claim 1 wherein the hydrotreating catalyst contains at least one of cobalt, molybdenum, nickel, and tungsten as catalytically active metal.

4. The process of claim 3 wherein the catalyst is nickel/molybdenum or cobalt/molybdenum on a refractory oxide support.

* * * * *